US009409047B2

(12) United States Patent
Kamenskikh

(10) Patent No.: US 9,409,047 B2
(45) Date of Patent: Aug. 9, 2016

(54) EXERCISE APPARATUS

(71) Applicant: Vitali Kamenskikh, Waterloo (CA)

(72) Inventor: Vitali Kamenskikh, Waterloo (CA)

(73) Assignee: Vitalika Inc, Waterloo, Ontario (CA)

( * ) Notice: Subject to any disclaimer, the term of this patent is extended or adjusted under 35 U.S.C. 154(b) by 224 days.

(21) Appl. No.: 13/766,976

(22) Filed: Feb. 14, 2013

(65) Prior Publication Data

US 2014/0228184 A1 Aug. 14, 2014

(51) Int. Cl.

*A63B 21/02* (2006.01)
*A63B 21/00* (2006.01)
*A63B 21/22* (2006.01)

(Continued)

(52) U.S. Cl.

CPC ..... *A63B 21/025* (2013.01); *A63B 21/0435* (2013.01); *A63B 21/153* (2013.01); *A63B 21/154* (2013.01); *A63B 21/227* (2013.01); *A63B 21/4003* (2015.10); *A63B 21/4013* (2015.10); *A63B 21/4029* (2015.10); *A63B 21/4043* (2015.10); *A63B 23/025* (2013.01); *A63B 23/03541* (2013.01); *A63B 21/002* (2013.01); *A63B 21/0023* (2013.01); *A63B 21/4035* (2015.10); *A63B 23/0405* (2013.01); *A63B 23/0482* (2013.01); *A63B 23/0488* (2013.01); *A63B 23/0494* (2013.01); *A63B 23/1263* (2013.01); *A63B 24/0087* (2013.01); *A63B 2208/0204* (2013.01); *A63B 2208/0238* (2013.01); *A63B 2208/0252* (2013.01); *A63B 2208/0257* (2013.01); *A63B 2210/04* (2013.01); *A63B 2210/06* (2013.01); *A63B 2210/50* (2013.01)

(58) Field of Classification Search

CPC .... A63B 21/0552; A63B 26/00; A63B 21/02; A63B 21/0442; A63B 21/023; A63B 21/04; A63B 21/00047; A63B 21/1434; A63B 21/154; A63B 22/0605; A63B 21/0001; A63B 21/00076; A63B 21/1457; A63B 21/1492; A63B 21/025; A63B 21/4029; A63B 21/4043; A63B 21/4003; A63B 21/4013; A63B 21/0435; A63B 23/03541; A63B 21/227; A63B 230/025; A63B 21/153; A63B 21/002; A63B 21/4035; A63B 24/0087; A63B 23/0494; A63B 2208/0204; A63B 23/0488; A63B 21/0023; A63B 23/0482; A63B 23/0405; A63B 2210/50; A63B 2208/0252; A63B 2208/0238; A63B 2210/06; A63B 2210/04; A63B 23/1263; A63B 2208/0257

USPC ..... 482/121–126, 133, 142, 51, 55, 56, 482/92–96, 114–116, 129–130, 131, 482/135–137, 140

See application file for complete search history.

(56) References Cited

U.S. PATENT DOCUMENTS 5,665,042 A * 9/1997 Breaux ..... 482/142
5,674,167 A * 10/1997 Piaget et al. ..... 482/130

(Continued)

*Primary Examiner* — Oren Ginsberg
*Assistant Examiner* — Andrew S Lo

(57) ABSTRACT

An exercise apparatus for supporting a range of resistance exercises, including exercises for providing bi-directional resistance to both the upper and lower body over a wide range of positions is disclosed. The exercise apparatus includes a base having a platform disposed thereon. An at least one elongated member is pivotally attached at its proximal end to each of the first and second ends of the base, and disposed in opposing relationship to form an at least one pair of opposing elongated members. An open loop resistance assembly is associated with each of the at least one pair of opposing elongated members. The resistance assembly functions to provide resistance against the direction of force applied by the user.

15 Claims, 15 Drawing Sheets

(51) Int. Cl.

| | |
|---|---|
| ***A63B 23/025*** | (2006.01) |
| ***A63B 23/035*** | (2006.01) |
| ***A63B 21/04*** | (2006.01) |
| *A63B 21/002* | (2006.01) |
| *A63B 23/04* | (2006.01) |
| *A63B 23/12* | (2006.01) |
| *A63B 24/00* | (2006.01) |

(56) References Cited

U.S. PATENT DOCUMENTS

| | | | | |
|---|---|---|---|---|
| 5,906,564 | A * | 5/1999 | Jacobsen | 482/96 |
| 5,928,117 | A * | 7/1999 | Vittone et al. | 482/99 |
| 6,245,001 | B1 * | 6/2001 | Siaperas | 482/142 |
| 6,805,409 | B2 * | 10/2004 | Parker | 297/377 |
| 7,285,077 | B1 * | 10/2007 | Marx | 482/104 |
| 7,288,050 | B2 * | 10/2007 | Murphy | 482/92 |
| 7,294,097 | B2 * | 11/2007 | Parker | 482/142 |
| D586,410 | S * | 2/2009 | Citterio | D21/673 |
| 7,625,320 | B2 * | 12/2009 | Wehrell | 482/92 |
| 7,998,036 | B2 * | 8/2011 | Ish, III | 482/100 |
| 8,235,874 | B2 * | 8/2012 | D'Eredita | 482/72 |
| D679,764 | S * | 4/2013 | Alessandri et al. | D21/675 |
| 2002/0132710 | A1 * | 9/2002 | Jacobsen | 482/123 |
| 2003/0017918 | A1 * | 1/2003 | Webb et al. | 482/94 |
| 2003/0087736 | A1 * | 5/2003 | Carter et al. | 482/142 |
| 2005/0070407 | A1 * | 3/2005 | Alessandri et al. | 482/148 |
| 2006/0019807 | A1 * | 1/2006 | Husted et al. | 482/128 |
| 2006/0258520 | A1 * | 11/2006 | Bowser | 482/121 |
| 2007/0015644 | A1 * | 1/2007 | Aucamp | 482/130 |
| 2007/0054790 | A1 * | 3/2007 | Dodge et al. | 482/121 |
| 2007/0117691 | A1 * | 5/2007 | Sechrest et al. | 482/97 |
| 2007/0135277 | A1 * | 6/2007 | Alessandri et al. | 482/121 |
| 2007/0167299 | A1 * | 7/2007 | Simonson et al. | 482/100 |
| 2007/0173390 | A1 * | 7/2007 | Roumayah | 482/140 |
| 2007/0270293 | A1 * | 11/2007 | Zhuang | 482/123 |
| 2008/0004166 | A1 * | 1/2008 | Oren et al. | 482/142 |
| 2008/0020912 | A1 * | 1/2008 | Dalebout et al. | 482/129 |
| 2008/0051263 | A1 * | 2/2008 | Rasmussen et al. | 482/94 |
| 2008/0287269 | A1 * | 11/2008 | Humble et al. | 482/92 |
| 2008/0318740 | A1 * | 12/2008 | Ross et al. | 482/92 |
| 2008/0318743 | A1 * | 12/2008 | Bizzell et al. | 482/142 |
| 2009/0017999 | A1 * | 1/2009 | Halbridge | 482/130 |
| 2009/0105052 | A1 * | 4/2009 | Dalebout et al. | 482/133 |
| 2009/0181833 | A1 * | 7/2009 | Cassidy et al. | 482/94 |
| 2010/0204024 | A1 * | 8/2010 | Mills et al. | 482/130 |
| 2010/0216612 | A1 * | 8/2010 | Graham | 482/121 |
| 2010/0255966 | A1 * | 10/2010 | Aucamp | 482/131 |
| 2010/0280549 | A1 * | 11/2010 | Yen | 606/237 |
| 2010/0323857 | A1 * | 12/2010 | D'Silva et al. | 482/121 |
| 2011/0009248 | A1 * | 1/2011 | Bronston et al. | 482/124 |
| 2011/0009249 | A1 * | 1/2011 | Campanaro et al. | 482/131 |
| 2011/0028281 | A1 * | 2/2011 | Ish et al. | 482/95 |
| 2011/0065554 | A1 * | 3/2011 | Van Straaten | 482/130 |
| 2011/0098163 | A1 * | 4/2011 | Radzwill | 482/142 |
| 2011/0166002 | A1 * | 7/2011 | Savsek et al. | 482/121 |
| 2011/0177921 | A1 * | 7/2011 | Olson et al. | 482/92 |
| 2011/0237405 | A1 * | 9/2011 | Reyes | 482/94 |
| 2011/0269604 | A1 * | 11/2011 | Tseng | 482/121 |
| 2012/0083395 | A1 * | 4/2012 | Carson | 482/129 |
| 2012/0202656 | A1 * | 8/2012 | Dorsay | 482/121 |
| 2013/0079203 | A1 * | 3/2013 | Jones | 482/130 |
| 2013/0130866 | A1 * | 5/2013 | Wehrell | 482/5 |
| 2013/0157818 | A1 * | 6/2013 | Lalaoua | 482/123 |
| 2013/0157824 | A1 * | 6/2013 | Chen | 482/142 |

* cited by examiner

EXERCISE APPARATUS

FIELD OF THE INVENTION

The present invention relates to exercise equipment and, in particular, to exercise equipment for providing resistance to the upper and lower body.

BACKGROUND OF THE INVENTION

Exercise equipment for providing resistance to the upper and lower body of a user are well known in the art. Such equipment generally includes a transportable component connected to a resistance means, wherein the user applies a force to the transportable component, thereby engaging the resistance means to provide resistance against the direction of the force applied by the user to the transportable component. Such resistance means typically take the form of a weight or weight stacks, and/or resistance cables or springs. Generally, resistance exercise equipment of the prior art variety is bulky and fails to support a range of resistance exercises, in particular exercises for providing bi-directional resistance to both the upper and lower body over a wide range of positions. What is needed is a portable exercise apparatus of simple construction and which overcomes at least the aforedescribed deficiencies.

SUMMARY OF THE INVENTION

In one embodiment of the present invention, there is provided an exercise apparatus having a base. A platform is disposed on an upper surface of the base and attached to the base. The platform serves to support a user of the apparatus. An at least one elongated member is pivotally attached at its proximal end to each of the first and second ends of the base by a connector, and disposed in opposing relationship to form an at least one pair of opposing elongated members. An open loop resistance assembly is associated with each of the at least one pair of opposing elongated members. The resistance assembly functions to provide resistance against the direction of force applied by the user. A cable, operatively connected to the resistance assembly and slidingly engaged with the distal end of each elongated member of each of the at least one pair of opposing elongated members, functions to transmit the force applied by the user to the resistance assembly, thereby engaging the resistance assembly to provide resistance against the direction of the force applied by the user.

The foregoing embodiment of the present invention, and other embodiments, will become more fully apparent from a review of the description and claims which follow.

Figure 1A:
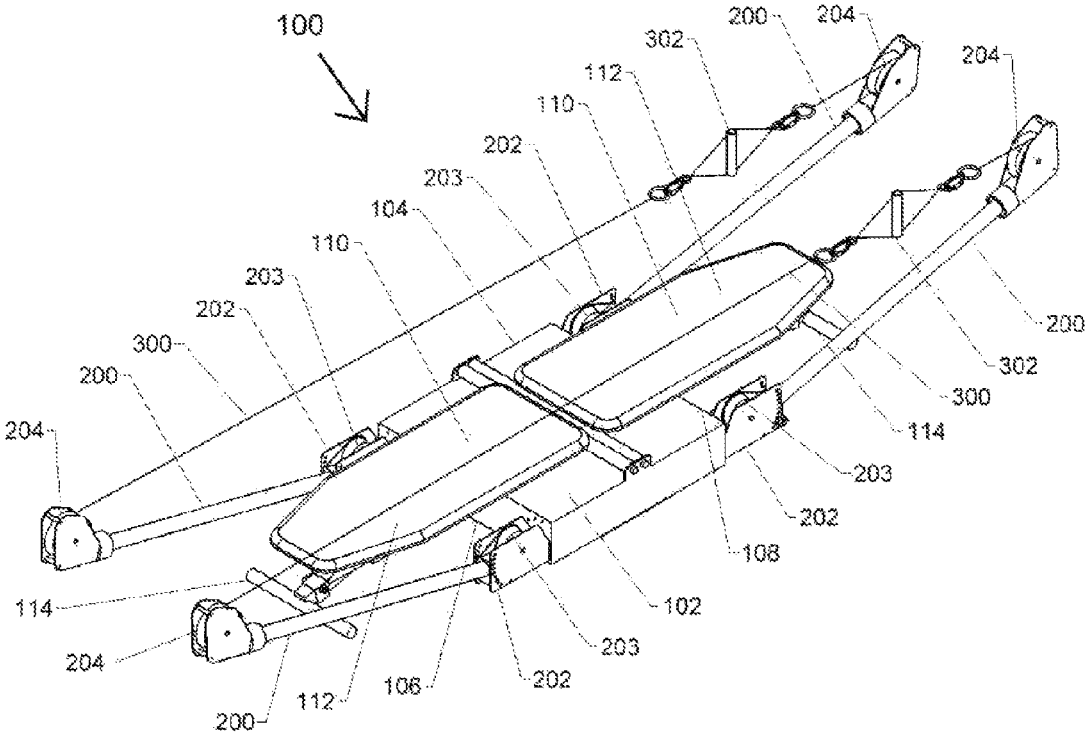
FIG. 1A is a perspective view of the exercise apparatus in accordance with one embodiment of the present invention.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION

All terms used herein are used in accordance with their ordinary meanings unless the context or definition clearly indicates otherwise. Also, unless indicated otherwise except within the claims the use of "or" includes "and" and vice-versa. Non-limiting terms are not to be construed as limiting unless expressly stated or the context clearly indicates otherwise (for example, "including", "having", "characterized by" and "comprising" typically indicate "including without limitation"). Singular forms included in the claims such as "a", "an" and "the" include the plural reference unless expressly stated or the context clearly indicates otherwise. Further, it will be appreciated by those skilled in the art that other variations of the preferred embodiments described below may also be practiced without departing from the scope of the invention.

Figure 1B:
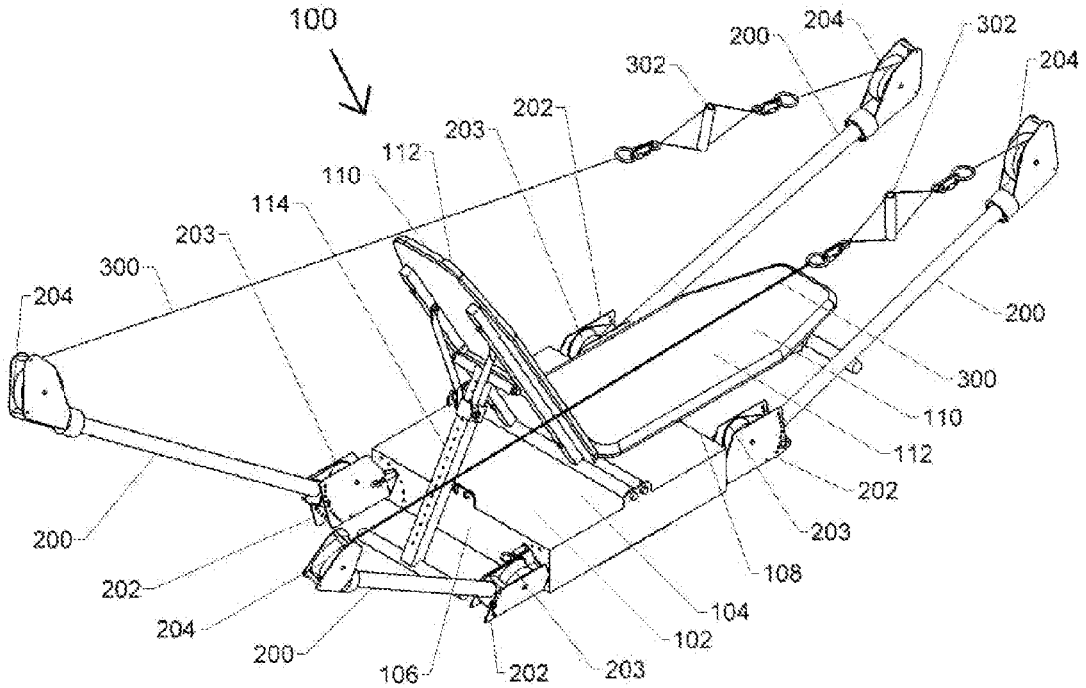
FIG. 1B is an alternate perspective view of the exercise apparatus of FIG. 1A wherein one of the planar supports of the platform is shown in an upright position.
Figure 2:
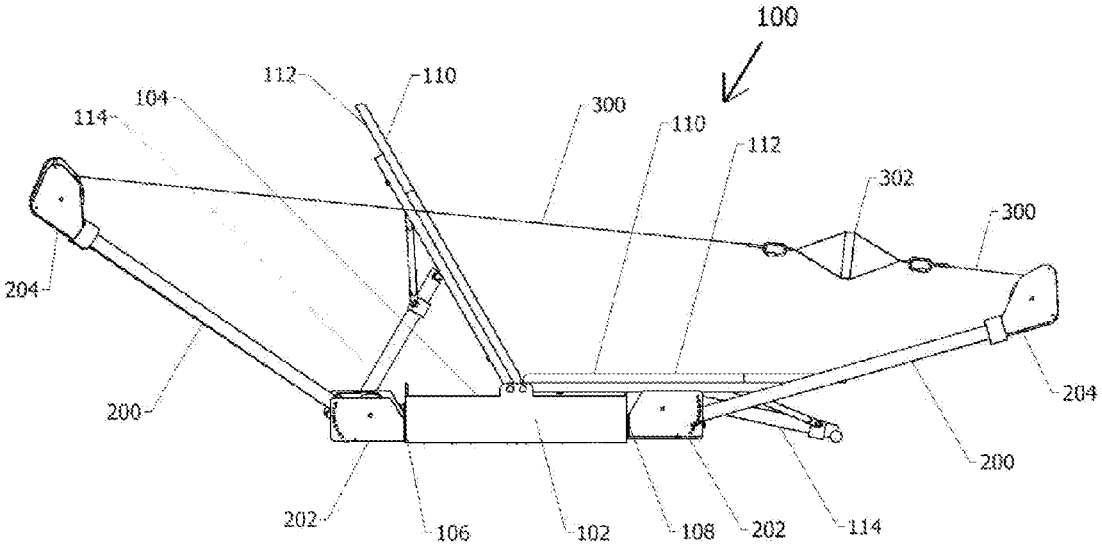
FIG. 2 is a left side view of the exercise apparatus of FIG. 1B.
Figure 4:
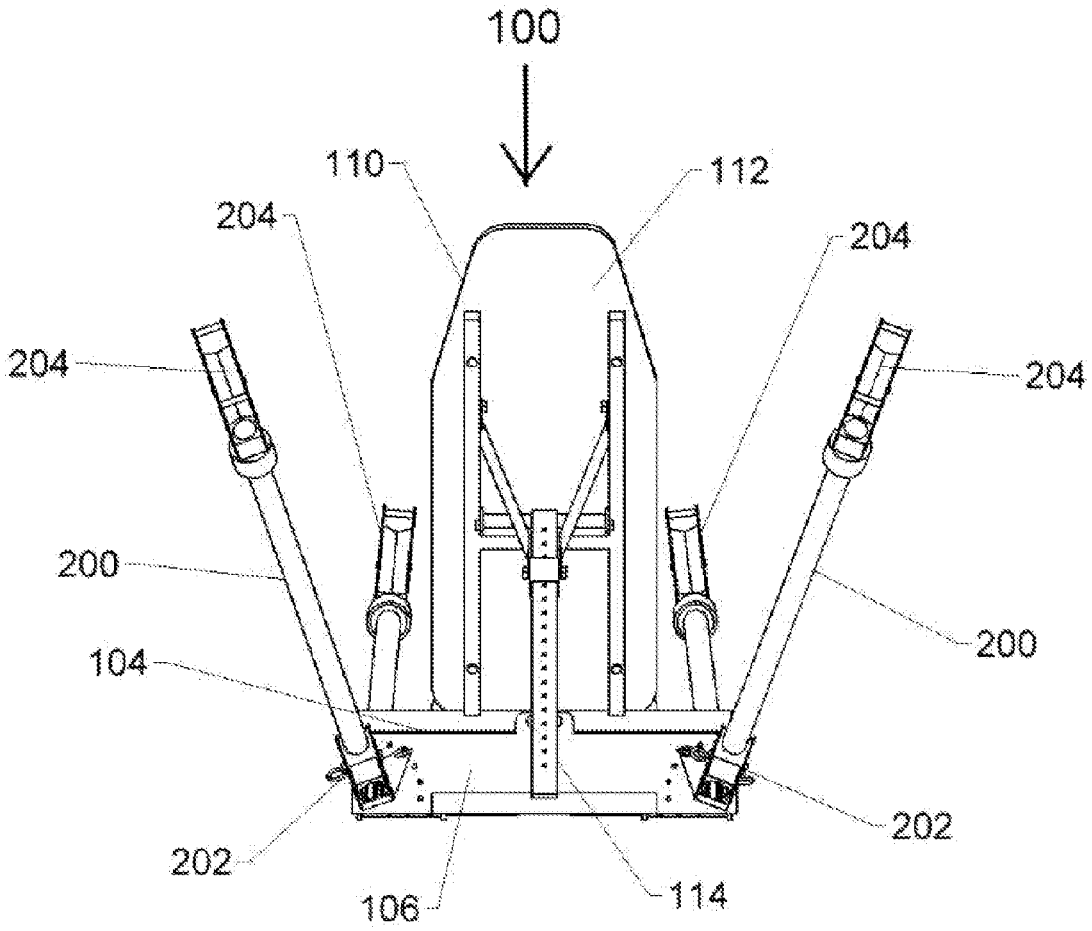
FIG. 4 is an end view of the exercise apparatus of FIG. 1B.

Referring to FIGS. 1A and 1B, an exercise apparatus is shown generally at reference numeral 100. The exercise apparatus 100 comprises a base 102 having an upper surface 104 and a lower surface (not shown), a first end 106 and a second end 108. The ends 106 and 108 are disposed at opposite sides of the base 102. In an embodiment of the present invention, the base 102 is quadrilateral in shape. A platform 110 is attached to the upper surface 104 of the base 102. The platform 110 serves to support the frame of a user, for example, whether the user is sitting, laying or standing on the platform 110. In an example embodiment, the platform 110 takes the form of a pair of planar supports 112, wherein the planar supports 112 are of substantially similar shape and dimension and each planar support 112 is pivotally mounted at a medial point on the base 102 via an end of each planar support 112, such that the planar supports 112 form a mirror image pair on the upper surface 104 of the base 102. Persons of skill in the art will appreciate that the platform 110 can take on a number of different arrangements without materially affecting the operation of the apparatus 100. For example, the planar supports 112 need not be of similar shape or dimension, mounted in mirror image relationship or medially positioned on the base 102. Moreover, the platform 110 itself need not be divided into planar support portions, but rather can take the form of a single planar support. Further, the platform 110 can optionally be fused with the upper surface 104 of the base 102 or removably attached thereto. In FIGS. 1B and 2, one of the planar supports 112 is shown in a substantially upright position and held in place by a foldable support bar 114 which is pivotally attached to the bottom side of the planar support 112. In FIG. 4, an end view of the apparatus 100 shows the support bar 114 in a use position propping up one of the planar supports 112. In the embodiment described in this part, the support bar 114 could be positioned at any location on the bottom side of the planar support 112 so long as the planar support is capable of being properly supported by the support bar 114.

Referring again to FIGS. 1A and 1B, an at least one elongated member 200 is pivotally attached by a connector 202 at its proximal end to each of the first 106 and second ends 108 of the base 102, such that the elongated members 200 are capable of pivoting outwardly along a first vertical plane from each end 106, 108 of the base 102 in opposing relationship with one another. In this way, each elongated member 200 on end 106 and its opposing elongated member 200 on end 108 form an opposing pair of elongated members (i.e. an elongated member pair). Optionally, the elongated members 200 of each opposing pair are positioned directly opposite one another on each side of the base 102, but the elongated members 200 within each pair could also be offset in relation to one another without materially affecting the function of the apparatus 100. In a preferred embodiment, two opposing elongated member pairs are positioned on each end 106, 108 and the elongated member pairs are spaced apart on each end 106, 108 such that the platform 110 fits between each elongated member pair.

With reference back to FIGS. 1A and 1B, positioned at the distal end of each elongated member 200 is a pulley 204 for engaging an open loop resistance assembly (not shown) associated with each of the at least one elongated member pairs. The structure and function of the resistance assembly is explained elsewhere in this description. A cable 300 associated with each open loop resistance assembly extends around the pulleys 204 of each elongate member pair. The distal end of the elongated member 200 need not be equipped with a pulley 204, however, in order to enable proper function of the apparatus, each cable 300 must be capable of easy movement about the distal end of the elongated member. An at least one engagement member 302 is removably attached to each cable 300. Each engagement member 302 functions to enable a user to control the movement of each cable 300. In an optional embodiment, each connector 202 includes a pulley 203 for receiving and supporting the cable 300 at the proximal end of each elongated member 200.

Each of the at least one engagement members can take on a different form depending on the exercise to be performed by a user of the apparatus 100. For example, where arm exercises are to be performed, each engagement member 302 can be in the form of a handle, whereas where leg exercises are to be performed, each engagement member 302 can take the form of an ankle brace. Multiple further variations of the engagement members 302 can be employed, (including, for example, a head support where neck exercises are to be performed) without departing from the scope of the invention. Two cables 300 must be used for each elongated member pair where the engagement member 302 is connected via two connection points between the cables 300, however, a user can optionally disconnect one such cable 300 where the user desires to operate the apparatus in conjunction with a single elongated member of an elongated member pair (for example, in the case where the user is making use of the option rowing assembly (discussed in further detail below)).

Figure 3:
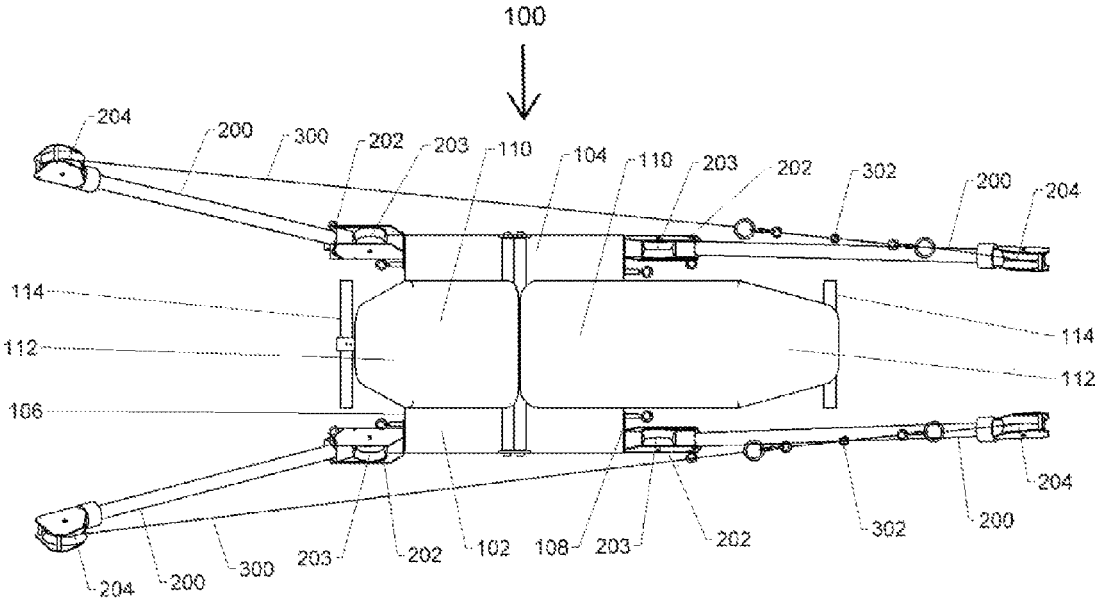
FIG. 3 is a top plan view of the exercise apparatus of FIG. 1B.

As depicted in FIGS. 3 and 4, each connector 202 may be adapted for pivotal connection to each end 106, 108 of the base 102, such that each connector 202, and its associated elongated member 200, can pivot along a second vertical plane, which vertical plane is perpendicular to the first vertical plane (previously described). In this way, full axial movement of each elongated member 200 may be achieved.

Figure 5:
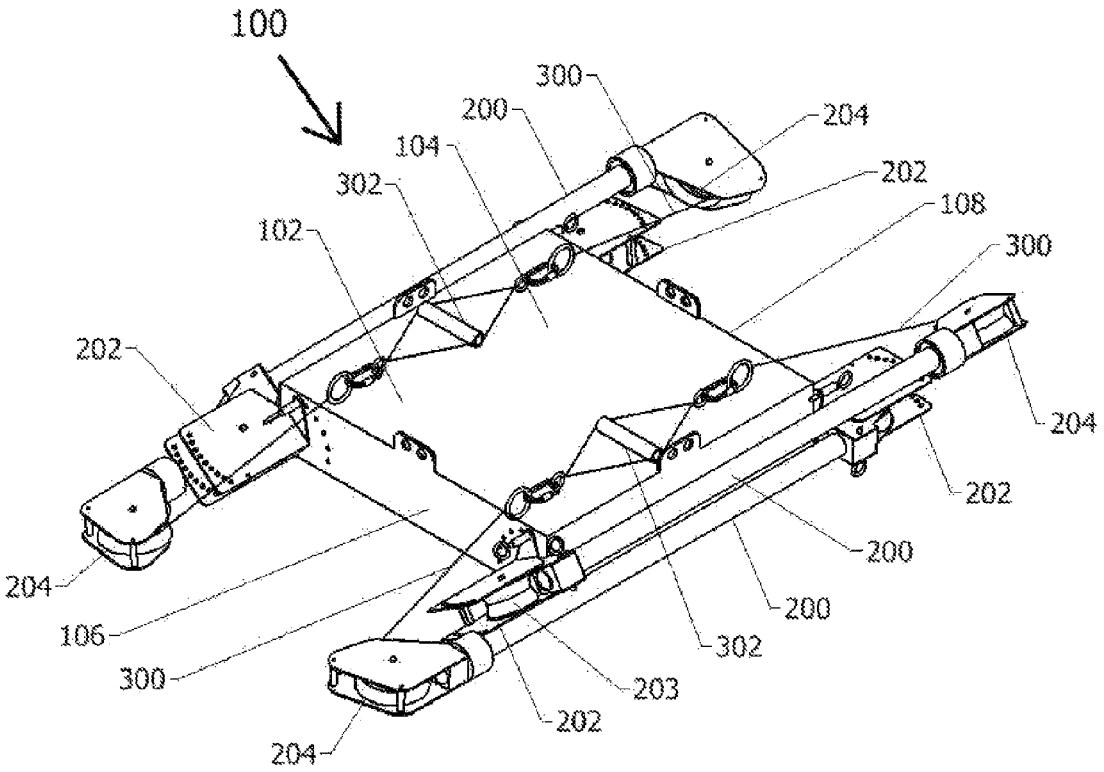
FIG. 5 is a perspective view of the exercise apparatus of FIG. 1A shown in a folded position.

In FIG. 5, the apparatus 100 is shown in a folded position. In order to convert the apparatus 100 from a use position, wherein each elongated member 200 is partially or fully pivoted outwardly from the ends 106, 108, to a folded position, a user can simply rotate each connector 202 and pivot the associated elongated members 200 inwardly in the direction of the base 102. In a preferred embodiment, each connector 202 is capable of rotating approximately 180° about a vertical axis of the base 102. In order to facilitate a compact folding of the apparatus 100 where one elongated member 200 of each pair is positioned on top of the other elongated member 200 of the elongated member pair in substantially parallel arrangement, the angle of rotation of each connector 202 may need to be adjusted by the user. When in a folded position, the apparatus 100 can be readily stored, for example, under a bed or in a closet.

Figure 6:
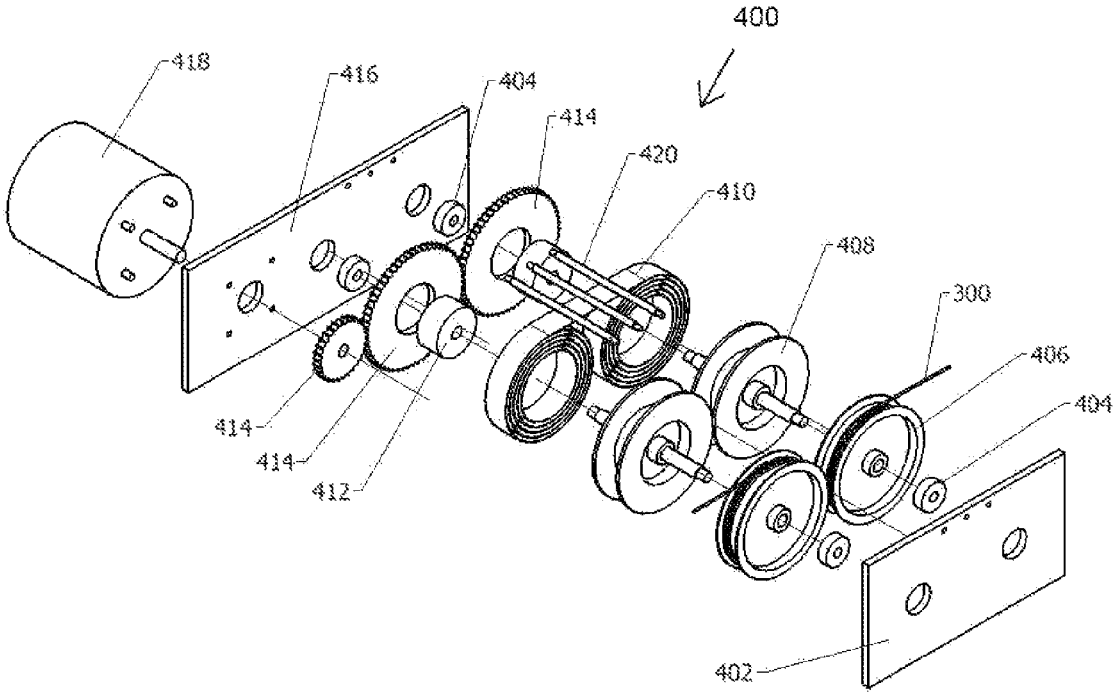
FIG. 6 is an exploded view of a resistance assembly in accordance with one embodiment of the present invention.
Figure 7:
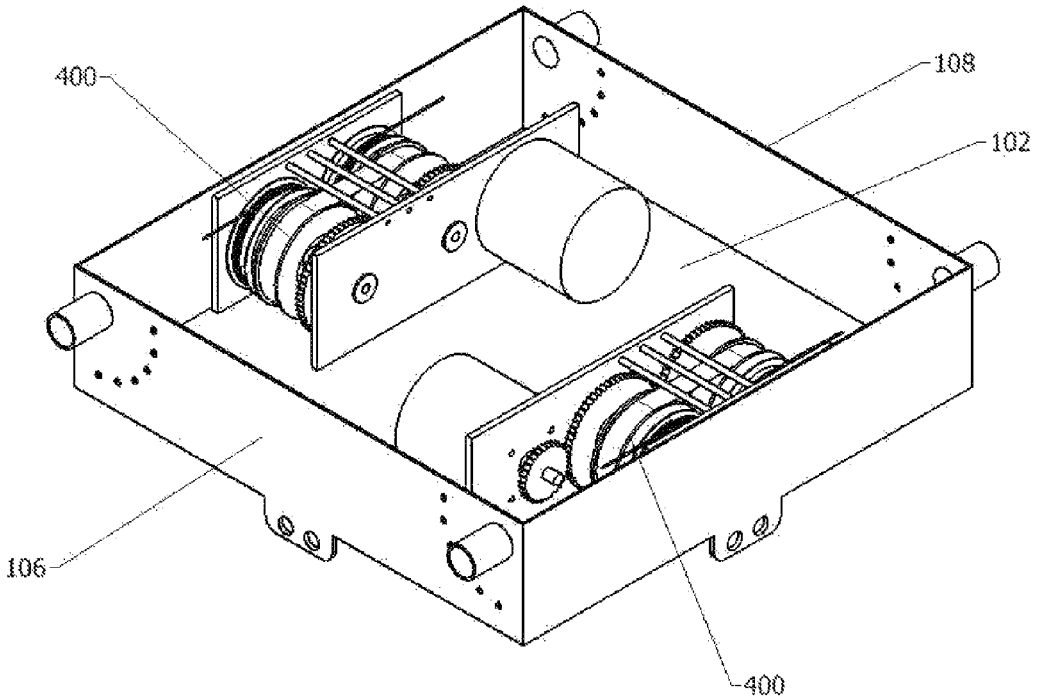
FIG. 7 is a perspective view of a resistance assembly in accordance with one embodiment of the present invention.

Referring next to FIG. 6, an exploded view of a resistance assembly 400 in accordance with one embodiment of the present invention is shown. Each resistance assembly 400 functions to provide resistance in response to exercise movements performed by a user of the apparatus 100, and at least one resistance assembly 400 is associated with each elongated member pair. In order to preserve the compact size of the apparatus 100, it is preferable position each such resistance assembly 400 within the hollowed out underside of the base 102, as illustrated in FIG. 7. In the embodiment shown in FIG. 7, each resistance assembly 400 is fixed to an inner sidewall of the base 102 on the underside of the upper surface 104 of the base. Each sidewall runs perpendicular to the ends 106, 108. Further, in the FIG. 7 embodiment, an aperture is disposed on each end 106, 108 of the base 102 for the purpose of accommodating the cable 300 (associated with each resistance assembly), which cable 300 runs in an open loop through the resistance assembly 400, as further described below.

Referring back to FIG. 6, the components of the resistance assembly 400 are set out. The resistance assembly 400 is housed substantially between two support plates 402 and 416. For the purpose of supporting bi-directional resistance training, each resistance assembly 400 is equipped with a pair of opposed resistance mechanisms, each of which cooperates with the cable 300 in an open loop system to enable a user to experience resistance whether the user applies a forward or backward force to the cable 300. Within the resistance assembly 400, the cable 300 is wound around two opposing cable spools 406. A spring spool 408 is rotatably attached to each cable spool 406, and optionally supported by a bearing 404 on each side thereof, and a torsion spring 410 is wound around each spring spool 408, each spring 410 for imparting a yielding resistance on its associated flywheel 412, axially connected to the spring spool and optionally supported by a bearing (not shown) on each side thereof, to move the flywheel 412 into a lock position when a force is applied to the cable 300. Each spring 410 serves a cable winding and unwinding function only, while the force applied to the cable 300 is distributed to the flywheel 412 itself. On reaching a lock position, and upon further application of force to the cable 300, an at least one gear 414, connected to the flywheel 412, is caused to rotate. Rotation of the at least one gear 414 engages a resistance element 418, wherein the resistance element 418 is operative to supply a resistance in response to a force applied by a user on the cable 300. Because the gears 414 on each side of the resistance assembly are operatively engaged with one another, each resistance assembly requires only a single resistance element 418. An at least one securement member 420 associated with each spring 410 may be employed for the purpose of preventing unspooling of each spring 410 from its associated spool 408. Each of the at least one securement members 420 is connected to the support plates 402 and 416.

In operation, when a user applies (for example) a substantially backward force to the cable 300 via the at least one engagement member 302, the cable 300 wound around the forward-most cable spool 406 will begin to unwind which in turn causes the associated flywheel 412 to rotate in the same direction as the rotation of the cable spool 406 and move the flywheel 412 into a lock position such that the rotation is transferred to the at least one associated gear 414, whereupon the resistance element 418 is engaged. The cable 300 on the rearward-most cable spool 406 of the resistance assembly 400 will become wound around the cable spool 406 as a force from the associated compressed spring 410 is applied to the cable spool 406 and transmitted into the cable spool 406, which in turn unlocks the associated flywheel 412 and disconnects the associated spring 410 and cable spool 406 from resistance element 418.

The resistance assembly 400 of the present invention will function even where a sideways force is applied to the cable 300 such that the cable portions on both sides of the engagement member 302 will be unwound at once. In this case, if the force applied to cable portions on both sides of the engagement member 302 is equal, then both flywheels of the associated resistance assembly will lock and an equivalent resistance force will be applied to the cable portions on either side of the engagement member 302. If the force applied to the cable portion on one side of the engagement member 302 is greater than on the other side, then the flywheel on the side having the greater applied force will lock and the resistance force will be applied to the cable on that side. Meanwhile, on the side having the lesser applied force, the cable on that side will be unwound at a slower rate and the flywheel on such side will remain unlocked. The form of resistance assembly described above enables a user to stop his or her exercise at any moment, without the need to park the engagement members 302 (this feature is particularly beneficial to users engaged in rehabilitation exercises, where such users' joints are particularly vulnerable to sudden movement). Note that any suitable cable resistance assembly of equivalent function could be substituted for the resistance assembly described above without materially affecting operation of the apparatus. For example, the resistance assembly could be a computer controlled resistance means for enabling a user to engage in isontonic and/or isokinetic resistance exercises.

Figure 8:
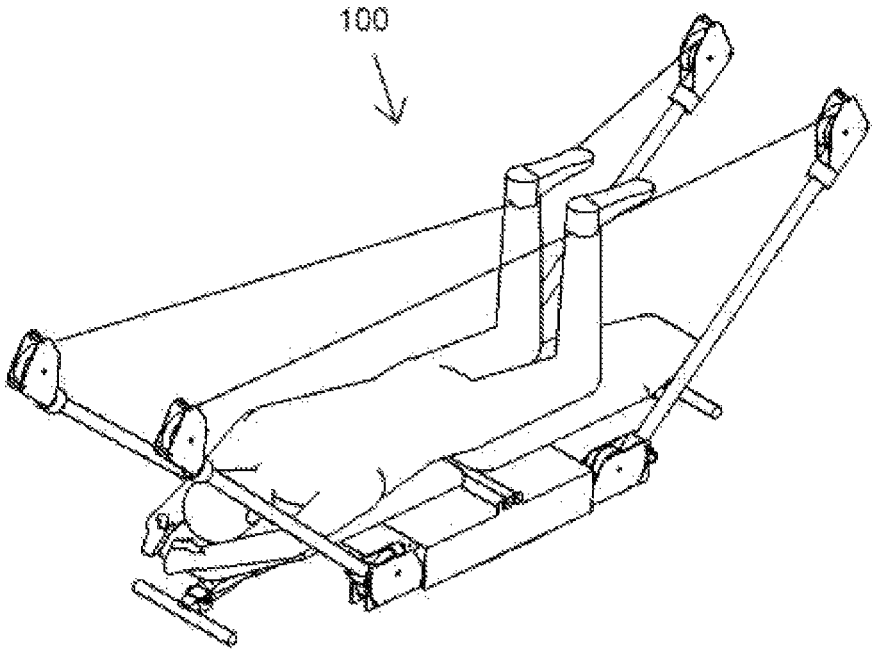
FIG. 8 is a perspective view of an exercise apparatus in accordance with one embodiment of the present invention showing a user engaged in a leg workout.
Figure 9A:
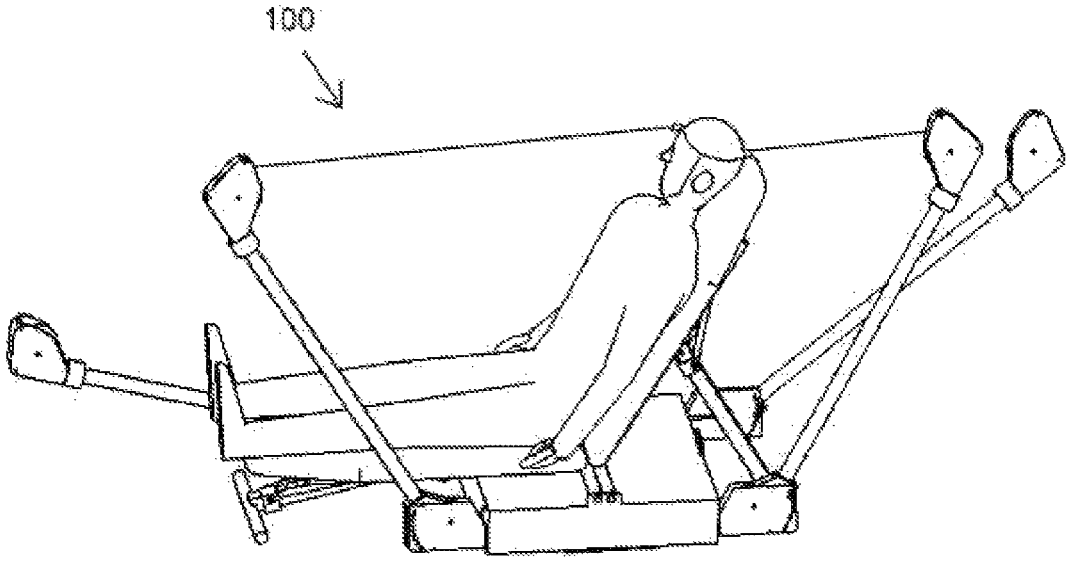
FIG. 9A is a perspective view of an exercise apparatus in accordance with one embodiment of the present invention showing a user engaged in a neck workout.
Figure 9B:
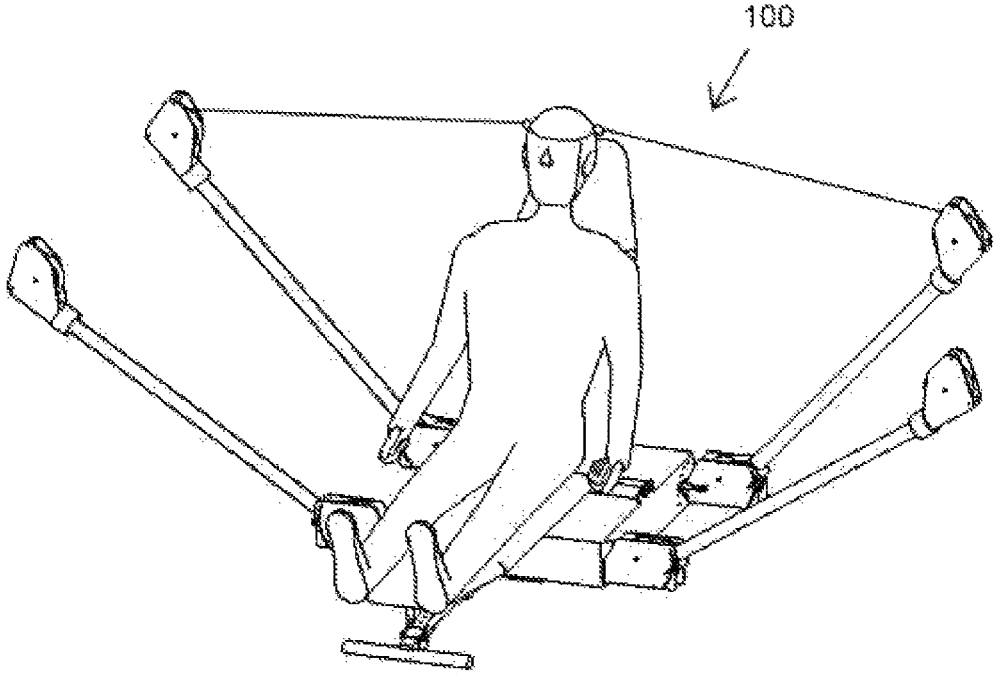
FIG. 9B is an alternate perspective view of the exercise apparatus of FIG. 9A.
Figure 10A:
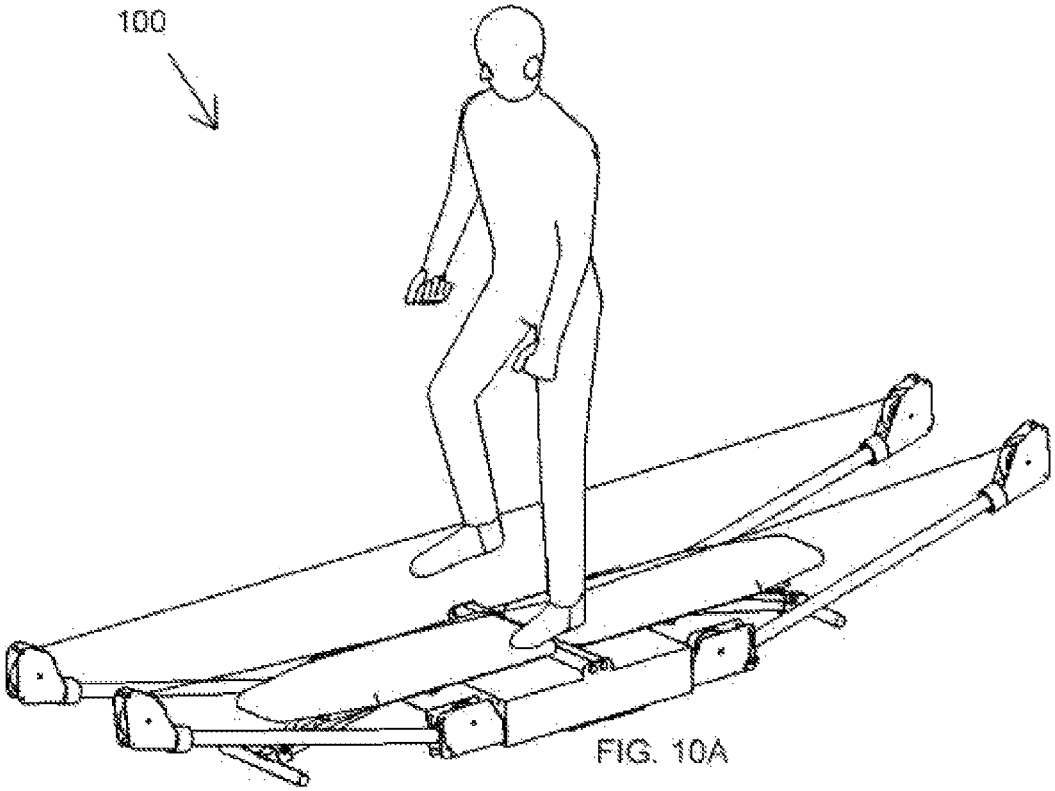
FIG. 10A is a perspective view of an exercise apparatus in accordance with one embodiment of the present invention showing a user engaged in a leg workout.
Figure 10B:
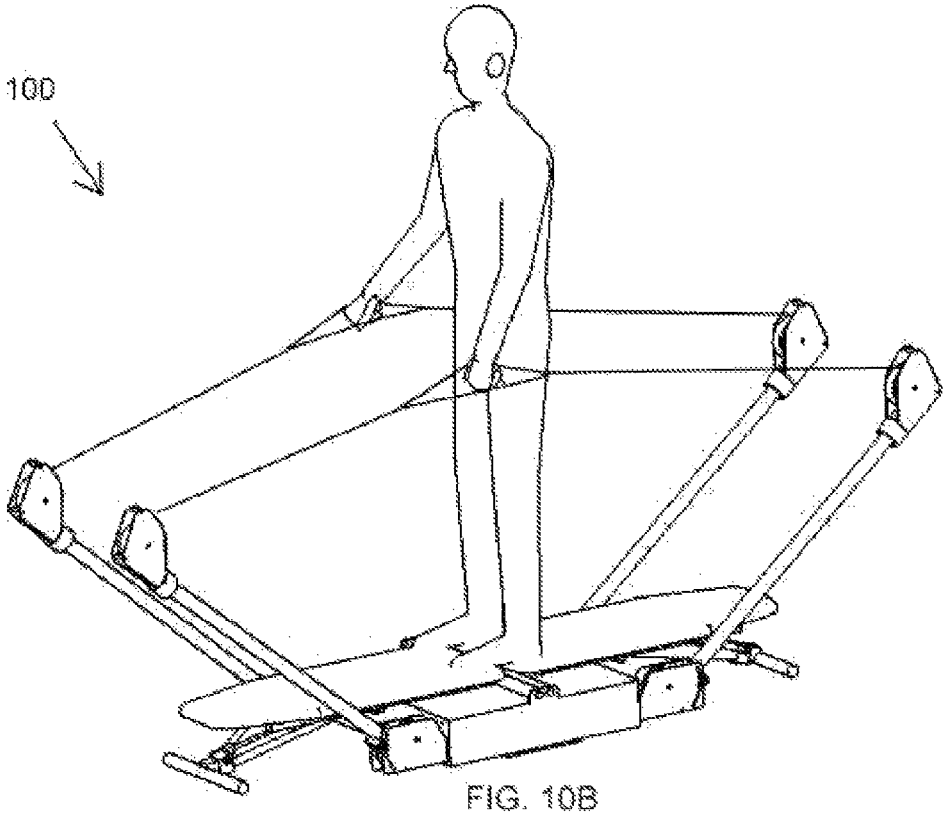
FIG. 10B is alternate perspective view of the exercise apparatus of FIG. 10A showing a user engaged in an arm workout.
Figure 11A:
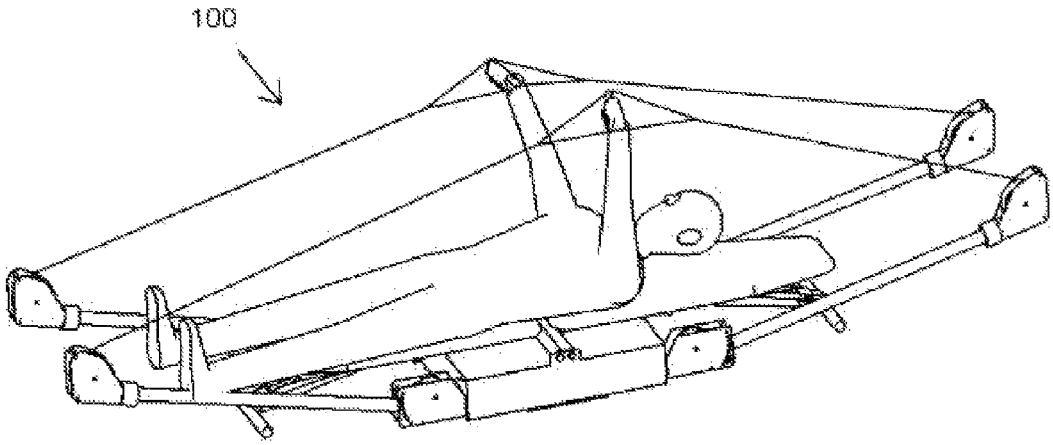
FIG. 11A is a perspective view of an exercise apparatus in accordance with one embodiment of the present invention showing a user engaged in an arm workout.
Figure 11B:
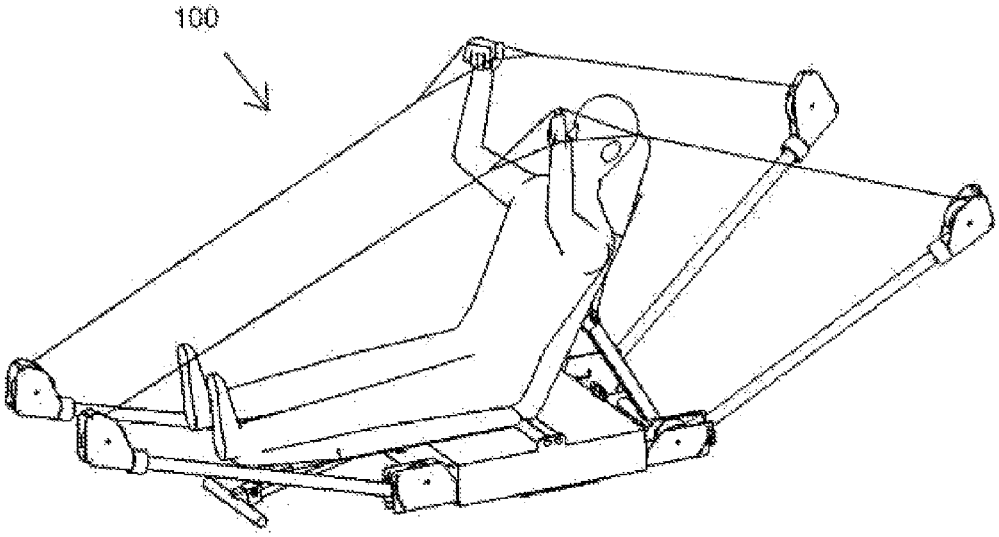
FIG. 11B is an alternate perspective view of the exercise apparatus of FIG. 11A showing a user engaged in an arm workout.
Figure 12A:
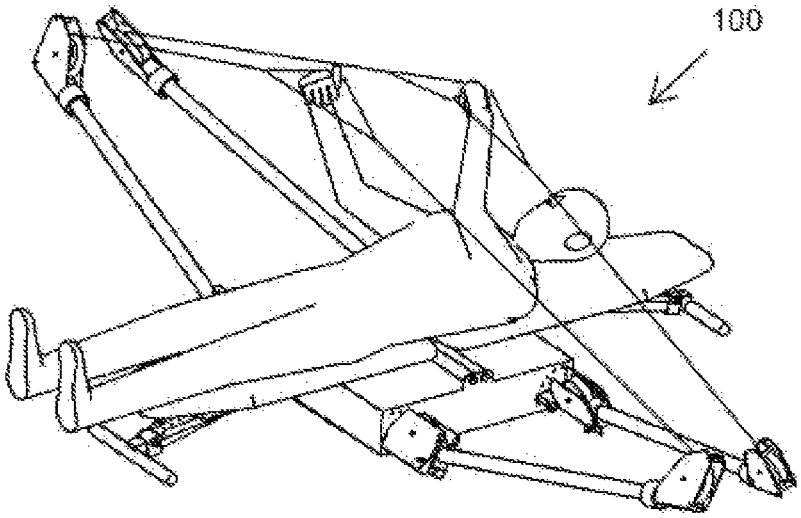
FIG. 12A is a perspective view of an exercise apparatus in accordance with one embodiment of the present invention showing a user engaged in an arm workout.
Figure 12B:
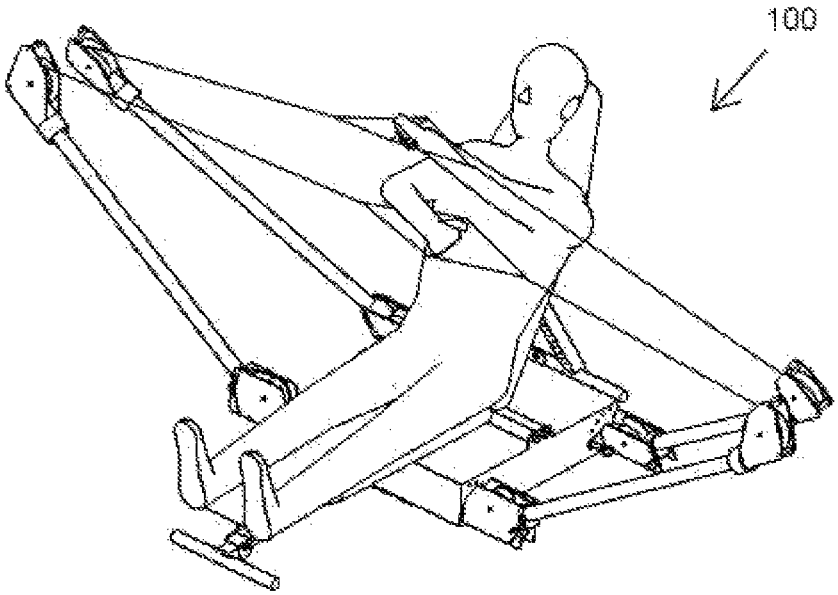
FIG. 12B is an alternate perspective view of the exercise apparatus of FIG. 12A showing a user engaged in an arm workout.
Figure 13A:
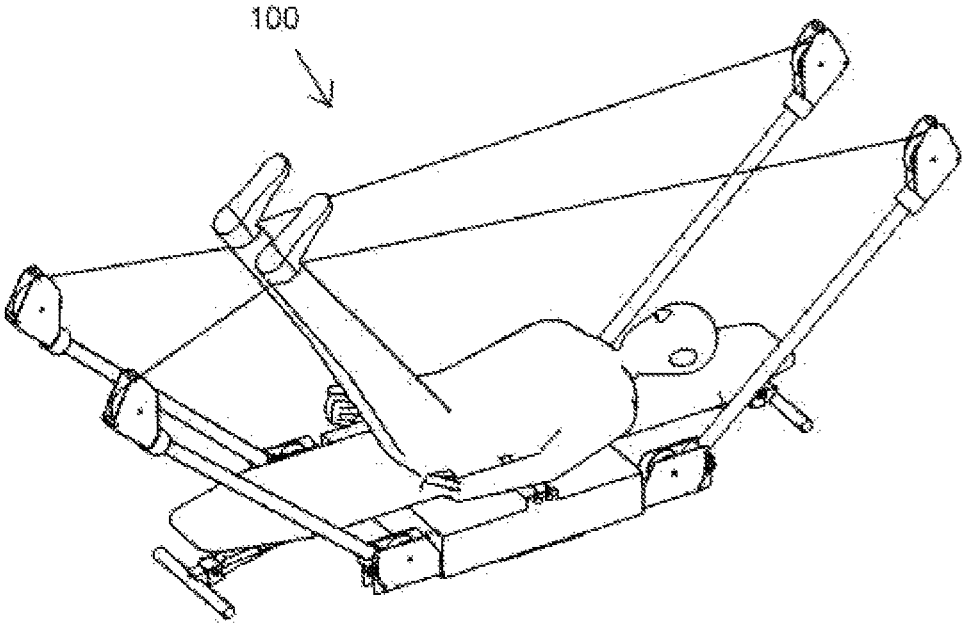
FIG. 13A is a perspective view of an exercise apparatus in accordance with one embodiment of the present invention showing a user engaged in a leg workout.
Figure 13B:
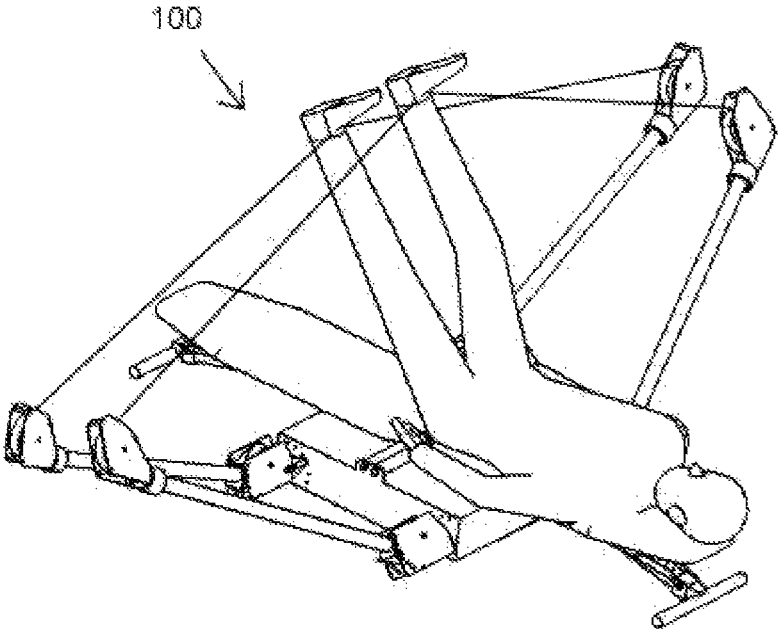
FIG. 13B is an alternate perspective view of the exercise apparatus of FIG. 13A showing a user engaged in a leg workout.

FIGS. 8 to 13B illustrate a range of exercise positions which may be adopted by a user of the apparatus. In FIG. 8, the user is depicted face down on the planar supports 112 and engaged in a lower body exercise wherein the engagement members are positioned around the user's ankles. In FIGS. 9A and 9B, an alternate form of engagement member is employed for attachment around the head of the user for the purpose of supporting an upper body neck exercise. In this exercise, the user is seated in an upright position as the planar support behind the user's back is supported by the accompanying support bar. Notably, the platform, whether in the form of planar supports or otherwise, can be positioned in parallel or perpendicular relationship to the elongated member pairs. In FIG. 9B, the planar supports are positioned perpendicular to the elongated member pairs. In FIGS. 10A and 10B, the planar supports are laid flat and the user is seen standing on the planar supports engaged in separate lower body and upper body exercises. FIGS. 11A and 11B depict the user engaged in upper body exercises while laying face up on the planar supports. In FIGS. 12A and 12B, the user is engaged in alternate upper body exercises while laying face up on the planar supports, however, unlike the embodiments shown in FIGS. 11A and 11B, the planar supports of FIGS. 12A and 12B are positioned normal to the elongated member pairs. FIGS. 13A and 13B illustrate still further examples of lower body leg exercise positions which may be adopted by a user of the apparatus. Persons of skill in the art will readily appreciate that the range of exercises supported by the apparatus of the present invention need not be limited to the examples presented herein.

Figure 14A:
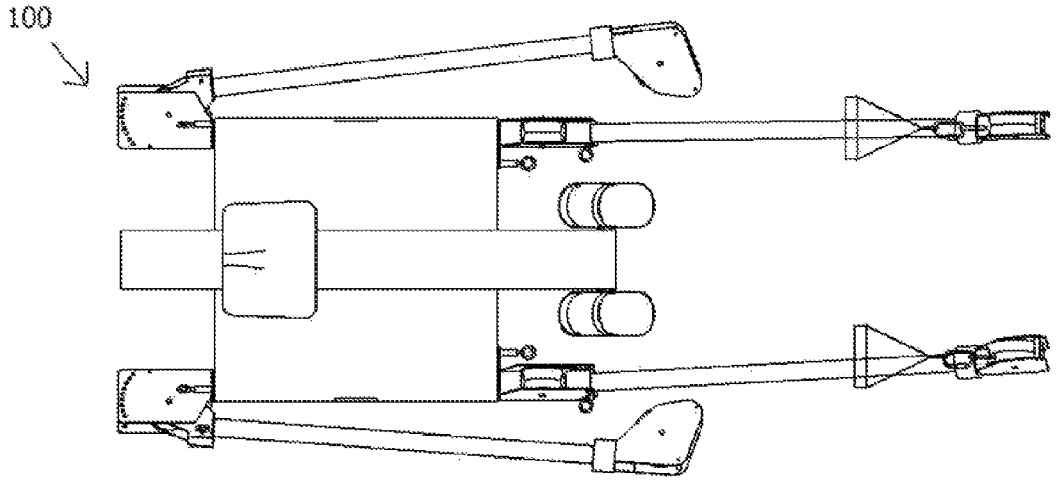
FIG. 14A is a top plan view of an exercise apparatus in accordance with one embodiment of the present invention showing a rowing assembly affixed to the platform.
Figure 14B:
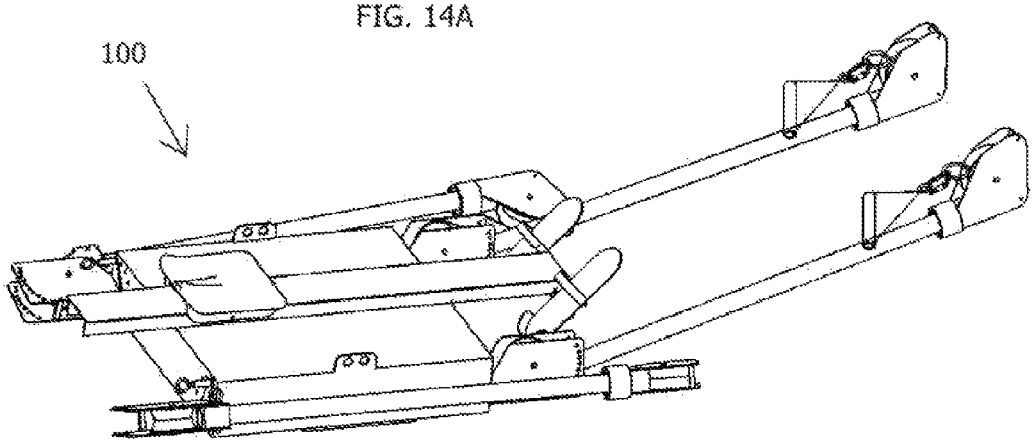
FIG. 14B is a perspective view of the exercise apparatus of FIG. 14A.

As depicted in FIGS. 14A and 14B, a rowing assembly attachment can be affixed to the upper surface 104 of the base 102 in place of the planar supports 112, which assembly includes a sliding seat portion mounted on a rail, and foot rests positioned proximal to the seat portion. In order to use the apparatus 100 as a rowing machine, a user can simply extend the elongated members 200 on the side of the foot rests outwardly from the base 102 and disconnect the cable 300 from the engagement member 302 at a connection point opposite the distal end of the engagement members 302. Where two elongated member pairs are employed, one cable 300 of each elongated member pair can be disconnected such that the user can engage one cable 300 with each hand.

Despite its elongate shape (when in a use position), the apparatus of the present invention is stable, and provides a stable platform for supporting a user since the base 102 has a low centre of gravity and the user must apply his or her own weight to the base 102 in order to make use of the apparatus.

While one or more embodiments of this invention have been illustrated in the accompanying drawings and described above, it will be evident to those skilled in the art that changes and modifications can be made therein without departing from the essence of this invention. All such modifications are believed to be within the sphere and scope of the invention as defined by the claims appended hereto.

What is claimed is:

1. An exercise apparatus comprising:

a base having an upper surface and a lower surface, and first and second ends;

a platform disposed on the upper surface of the base and attached thereto, the platform comprised of a pair of planar supports, each pivotally connected to the base, the platform for supporting a user;

at least one elongated member pivotally attached at its proximal end to each of the first and second ends of the base by a connector, and disposed in opposing relationship to form an at least one pair of opposing elongated members;

an open loop resistance assembly associated with each of the at least one pair of opposing elongated members, the resistance assembly for providing resistance against a direction of force applied by the user; and a cable operatively connected to the resistance assembly and slidingly engaged with a distal end of each elongated member of the at least one pair of opposing elongated members, the cable for transmitting the force applied by the user to the resistance assembly, thereby engaging the resistance assembly to provide resistance against the direction of the force applied by the user.

2. The exercise apparatus of claim 1 further comprising a pulley disposed on the distal end of each of the at least one elongated members, the pulley for guiding movement of the cable at the distal end of each of the at least one elongated members.

3. The exercise apparatus of claim 1 wherein two elongated members are pivotally attached at their proximal ends to each of the first and second ends of the base, and disposed in opposing relationship to form two pairs of opposing elongated members.

4. The exercise apparatus of claim 3 wherein each of the two pairs of opposing elongated members are spaced apart on the first and second ends of the base.

5. The exercise apparatus of claim 4 wherein each of the two pairs of opposing elongated members are disposed at a distal end of the first and second ends of the base.

6. The exercise apparatus of claim 1 further comprising an at least one engagement member attached to each cable, each of the at least one engagement members for enabling the user to control the movement of each cable by contact of each of the at least one engagement members with a portion of the user's body.

7. The apparatus of claim 6 wherein each of the at least one engagement members is removably attached to each cable.

8. The exercise apparatus of claim 6 wherein each of the at least one engagement members takes the form of a handle for engaging a hand of the user.

9. The exercise apparatus of claim 1 wherein the planar supports are of substantially similar dimension.

10. The exercise apparatus of claim 1 further comprising an at least one support bar pivotally connected to a lower surface of each planar support, each support bar for holding each planar support in an elevated position.

11. The exercise apparatus of claim 1 wherein each of the at least one elongated members is capable of pivoting outwardly along a first vertical plane from each end the base.

12. The exercise apparatus of claim 10 wherein each connector is rotatably attached to the base, such that each connector and its associated elongated member is capable of pivoting along a second vertical plane, such that full axial movement of each of the at least one elongated members is achieved.

13. The exercise apparatus of claim 12 wherein the first vertical plane is substantially perpendicular to the second vertical plane.

14. The exercise apparatus of claim 11 wherein each connector is rotatably attached to the base, such that each connector and its associated elongated member is capable of pivoting along a second vertical plane, such that full axial movement of each of the at least one elongated members is achieved.

15. The exercise apparatus of claim 14 wherein the first vertical plane is substantially perpendicular to the second vertical plane.

* * * * *